United States Patent [19]

Pacione

[11] Patent Number: 4,974,384

[45] Date of Patent: Dec. 4, 1990

[54] STRUCTURAL ASSEMBLY SYSTEM

[75] Inventor: Joseph R. Pacione, Thornhill, Canada

[73] Assignee: Tac-Fast System SA, Fribourg, Switzerland

[21] Appl. No.: 268,341

[22] Filed: Nov. 7, 1988

[51] Int. Cl.[5] ..... E04B 2/82

[52] U.S. Cl. ..... 52/483; 52/241; 52/DIG. 13

[58] Field of Search ..... 52/262, 480, 483, 241, 52/479, 346, DIG. 13

[56] References Cited

U.S. PATENT DOCUMENTS

| | | | |
|---|---|---|---|
| 1,620,574 | 3/1927 | Savage | 52/DIG. 13 |
| 3,391,434 | 7/1968 | Girard | 52/DIG. 13 |
| 3,444,657 | 5/1969 | Swanson . | |
| 3,475,810 | 11/1969 | Mates | 52/DIG. 13 |
| 3,571,999 | 3/1971 | Downing . | |
| 3,583,057 | 6/1971 | Kolozsvary . | |
| 3,721,050 | 3/1973 | Perina . | |
| 3,780,479 | 12/1973 | Billarant et al. | 52/483 X |
| 3,807,112 | 4/1974 | Perina . | |
| 3,817,015 | 6/1974 | Frangos . | |
| 3,858,269 | 1/1975 | Sutton et al. . | |
| 3,859,765 | 1/1975 | Nelsson | 52/241 |
| 3,863,412 | 2/1975 | Bodycomb et al. | 52/483 |
| 3,870,112 | 4/1974 | Perina | 52/241 |
| 4,012,544 | 3/1977 | Richards . | |
| 4,041,667 | 8/1977 | Linder et al. | 52/483 |
| 4,069,639 | 1/1978 | Lindner . | |
| 4,090,335 | 5/1978 | Curatolo . | |
| 4,114,346 | 9/1978 | Kelly . | |
| 4,118,903 | 10/1978 | Coulthard | 52/DIG. 13 |
| 4,177,305 | 12/1979 | Feingold et al. . | |
| 4,281,211 | 7/1981 | Tatum et al. . | |
| 4,350,721 | 9/1982 | Nagase . | |
| 4,353,193 | 10/1982 | Sanderson . | |

(List continued on next page.)

FOREIGN PATENT DOCUMENTS

| | | | |
|---|---|---|---|
| 8603164 | 6/1986 | European Pat. Off. . | |
| 492101 | 11/1930 | Fed. Rep. of Germany . | |
| 1575199 | 11/1971 | Fed. Rep. of Germany . | |
| 2201231 | 7/1973 | Fed. Rep. of Germany . | |
| 2803006 | 8/1979 | Fed. Rep. of Germany . | |
| 3416511 | 11/1985 | Fed. Rep. of Germany . | |
| 3531489 | 10/1935 | France . | |
| 7229736 | 3/1973 | France . | |
| 7631780 | 5/1976 | France . | |
| 267519 | 7/1967 | U.S.S.R. . | |
| 518590 | 3/1940 | United Kingdom . | |
| 1204886 | 9/1970 | United Kingdom . | |
| 1376262 | 12/1974 | United Kingdom . | |
| 1472729 | 5/1977 | United Kingdom . | |
| 1546901 | 5/1979 | United Kingdom . | |
| 2188080 | 9/1987 | United Kingdom . | |
| 2197357 | 5/1988 | United Kingdom | 52/DIG. 13 |

OTHER PUBLICATIONS

Mad Magazine.
Snap Wall Publication.
Fishing Operations in Construction.
Velcro Nylon Fasteners by Velcro Canada Ltd./Ltee.
Total Learning Concept pp. 1–91; 135–140; 159–165; Q–1–Q–4.
The How–To Handbook of Carpets by A. S. Garstein 1979.

*Primary Examiner*—Richard E. Chilcot, Jr.
*Attorney, Agent, or Firm*—Brian W. Gray; Robert H. Wilkes

[57] ABSTRACT

Re-attachable structural assemblies incorporating complementary area fastening elements comprising hook and loop elements over extended rigid contact surfaces between structural members of an assembly are disclosed for use in the construction industry in relation to: temporary formwork for casting concrete; precast concrete components for permanent installation of finished surfaces; and, fabricated floor and wall systems including joists, sub-floors, and floor covering surface units. The use of synthetic hook and loop attachment systems affords significant savings in time, labor, and frequently in materials, particularly in the temporary formwork application.

16 Claims, 3 Drawing Sheets

U.S. PATENT DOCUMENTS 4,361,610 11/1982 Roth .
4,405,668 9/1983 Wald .
4,491,166 1/1985 Hanna ..... 52/DIG. 13
4,557,774 12/1985 Hoopengardner .
4,581,269 4/1986 Tilman .
4,581,274 4/1986 Johns et al. .
4,602,124 7/1986 Santucci .
4,635,418 1/1987 Hobgood .
4,648,592 3/1987 Harinishi ..... 52/480 X
4,671,976 6/1987 Vidal .
4,673,603 6/1987 Roth .
4,691,478 9/1987 Lorg .
4,711,025 12/1987 DeSanto .
4,722,146 2/1988 Kemeny .
4,730,423 3/1988 Schafer et al. .
4,744,189 5/1988 Wilson ..... 52/DIG. 13
4,747,246 5/1988 Sanborn .

10
14
12
29
16
27
20
24
41
18
22

STRUCTURAL ASSEMBLY SYSTEM

FIELD OF THE INVENTION

This invention is directed to heavy construction attachment systems, in particular, to a system incorporating major disassembable units and to the units of the system.

BACKGROUND TO THE INVENTION

In the construction industry, concrete foundations are commonly manufactured by using formwork into which concrete is poured. This formwork usually consists of re-usable wood and aluminum composite struts and joists which provide a supporting crib-work or lattice for the actual sheathing members onto which the concrete is poured. The sheathing frequently consists of plain or paper faced plywood members. Thus, a substantial plywood sheathing sheet for example ¾ inch ply, having a replaceable paper liner as the casting surface, is usually nailed to an underlying supporting joist having an inset nailing strip. After the concrete has set, the underlying formwork lattice and plywood is removed. Frequently the plywood has to be torn down, owing to the entrainment of the attachment nails into the concrete. Similarly, the face of the plywood may be penetrated by the concrete and become damaged. The wood nailing strips of the supporting laticework will become damaged over time due to repeated re-use and will have to be replaced. Considerable expenditures in material and labour costs are therefore involved, and valuable resources are used up.

The present method of manufacturing concrete foundations also has a drawback in that seam outlines of the 4×8 foot sheathing sheets, caused by misalignments, gaps and penetrating cement flashings must be ground away where a smooth finished surface is required.

The use of hook and loop elements for the purpose of joining flexible elements is not new. The garment and footwear industries have for many years employed a particular hook and loop type attachment material, commonly referred to by the trade mark VELCRO, for securing the adjacent surfaces of clothing and footwear. However, this material is limited both by the presently available widths, which do not exceed four inches, and by the maximum anchoring force developed by the plastic hook elements. Furthermore, prior usage appears to have been concentrated on the application of this type of fastener in areas where a peeling, wave-like relative movement can be used to attach and detach a pair of complementary hook and loop surfaces, as when opening a garment or a shoe flap or on the installation of decorative, non-structural panels such as shown in Wilson, U.S. Pat. No. 4,744,189 issued May 17, 1988 or room dividers such as shown in Curatolo, U.S. Pat. No. 4,090,335 issued May 23, 1978.

SUMMARY OF THE INVENTION

The present invention provides a building construction having a plurality of rigid standard components for assembly in layered, substantially planer facing relation, a first such standard component manufactured in standard lengths with a first part of a hook and loop fastening system along a surface of the standard component; a second such standard component having a second part of a hook and loop fastening system of complementary attachability to the first part along at least one surface of the second component, so that such components can be cut and fit as necessary in the building construction and engaged with each other by face to face detachable engagement between the first and second parts of the hook and lopp fastening system.

In one embodiment the building component portions may be positioned in substantially horizontally oriented, substantially planar relation.

In a further embodiment the building component portions may be positioned in inclined oriented relation, such as component parts of a partition wall.

In an alternative embodiment the construction may be temporary, having a plurality of layers, with attachment components secured in releasable joining connection between more than one pair of opposed interfaces of the construction layers.

The present invention discloses in one embodiment a system for manufacturing concrete structures in which re-usable hook and loop area fasteners are secured to component portions and used to attach formwork components in face-to-face mutually adherent, detachable relation.

In this embodiment one of the layers on which the formwork is erected may become embeded in and left with the concrete for later use in attaching finishing details such as surface decoration, rugs or wall paper.

The invention further provides an attachment system having releasable connecting elements for adhering to concrete, to enable the provision of removable and substitutable surface finish members in attached relation by way of the connecting elements to the concrete structure. Such surfaces may be walls, floors and/or ceilings.

The invention further provides a building system wherein a layer of first connecting elements is secured in permanently adhered relation to a first access face of a structure, to form an integral part thereof, for use in securing a second reverse face of a complementary structure in secured relation at the interface therewith, having a layer of second fastening elements located at the interface in engaging relation with the first layer of first elements.

Thus, a carpet or other floor covering having suitable fastening elements on the undersurface, or ceiling panels or tiles having appropriate fastening elements on the upper surface may be readily, detachably secured to an appropriate structure. Similarly, wall surfaces for partitions and the like can be attached to a stud system. Also, the elements of the stud system may incorporate such complementary layered fastening elements.

In one embodiment a lattice of supporting members includes at least a first face of a first member in pressing, adjoined relation with a second face of a second member, each member having secured thereto one component portion of a two component connecting means, to form a connecting interface between the members. Such a connection may be used in concrete formwork, or in a permanent floor joist and sub-floor construction, as well as in wall constructions.

In another embodiment, a structural member is provided with a surface connecting means component part in bonded relation to a first surface portion thereof, for use in attaching a second member having a second surface with a complementary surface connecting means in bonded relation thereto, for joinder of the first and the second members.

In another embodiment a structural member having a first surface with a layer of surface connecting means first component parts mounted to a backing sheet and bonded to the member is provided with a removable protective cover secured thereover in protective relation, the protective cover including on one face thereof a layer of surface connecting means second components complementary to the first components of the connecting means, to permit the attachment and removal of the protective cover and exposure of the surface layer of connecting means first components. Such an embodiment may comprise a floor and sub-floor construction, wherein the protective cover remains in place during the completion of construction, so as to protect the surface connecting means therebeneath. Subsequently, a carpet or other covering may be substituted wherein the protected underlying connecting components are utilized to removably secure the covering to the subfloor.

In general, the area fastening elements of complementary hooks and loops are of synthetic material, formulated in layers attached to backing sheets to facilitate area coverage by way of the attachment means, so as to develop the requisite attachment strength.

BRIEF DESCRIPTION OF THE DRAWINGS

Certain embodiments of the invention are described, without limiting the invention thereto, reference being made to the accompanying drawings, wherein;

FIG. 7 is a general view in exploded relation showing the elements of a portion of a partition wall embodying the invention.

DETAILED DESCRIPTION OF THE INVENTION

In the making of the present invention it will be appreciated that certain inherent deficiencies and limitations of presently available hook and loop fasteners, such as the presently limited width of four inches in the VELCRO product, and the present upper limit on its gross developed joint strength can be overcome by the provision of wide width sheets of the respective hook and loop elements, the development of elements of improved characteristics and the adoption of improved manufacturing processes for the fasteners. An aspect of the components presented is the integration of a hook and loop fastening system into the surfaces of the products. What is described is an incorporation of this system directly into the elements comprising the building system. This aspect is required in order to provide the necessary flexibility of attachment when products are to be transported to the site as standard components or cut and fit on site for assembly into a building.

In addition, the invention presented in this application as well as previous application No. 148,711 filed Jan. 26, 1988 ANCHOR BOARD SYSTEM are not fastening products per se but rather are new designs of conventional building materials.

Figure 1:
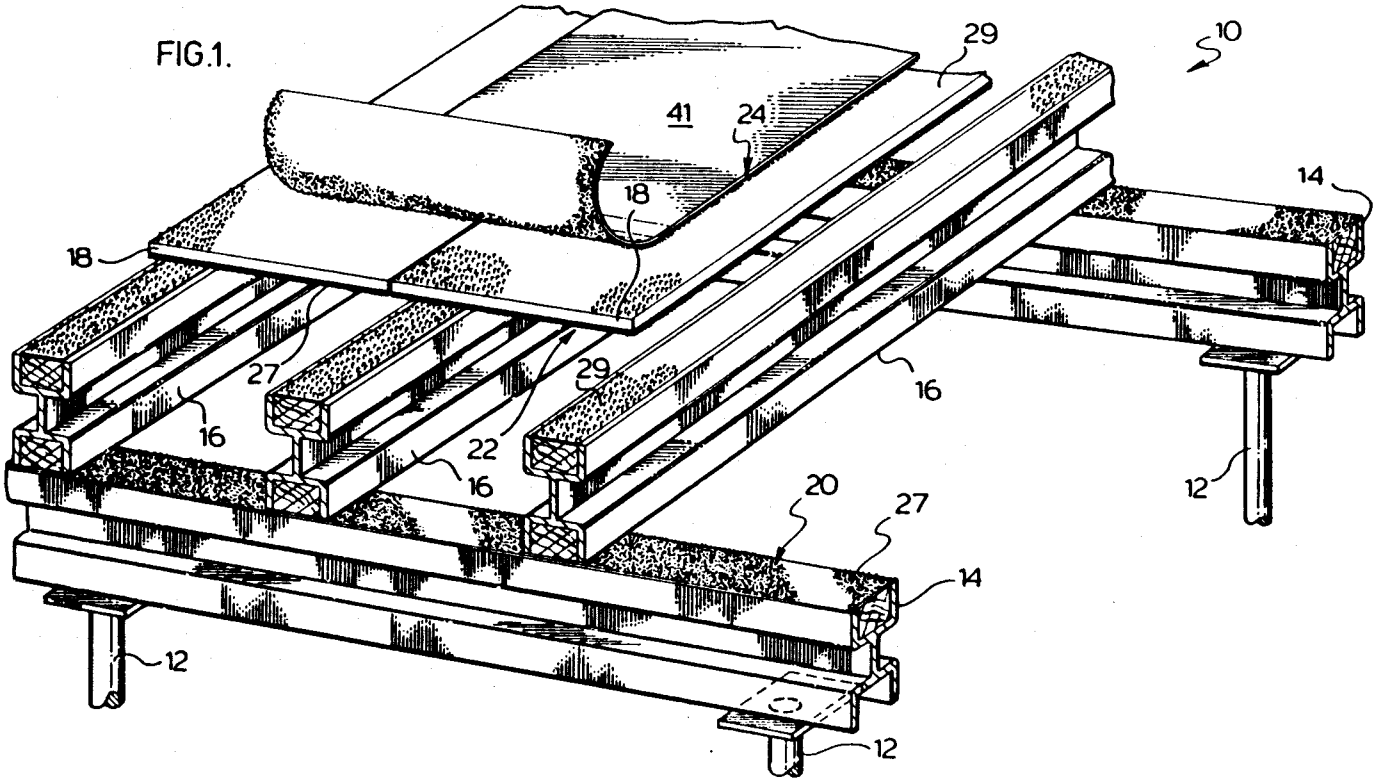
FIG. 1 is a general view of a concrete formwork system in accordance with the present invention, in partially exploded relation.

Referring to FIG. 1, a concrete formwork assembly 10 comprises a number of supporting struts 12 carrying beams 14 across which are laid joists 16, to which sheathing sheets 18 are secured.

A covering 41 overlays the gaps or joints 39 between adjoining sheathing sheets 18. At the interfaces 11, 22, 24 between the respective rigid components 14, 16, 18 area fastening elements comprising loops 27 and hooks 29 are located, to attach the respective components in securely anchored relation.

The covering 41 also utilizes area fastening elements comprising loops 27 and hooks 29 to secure it to the sheathing sheets 18.

Figure 2:
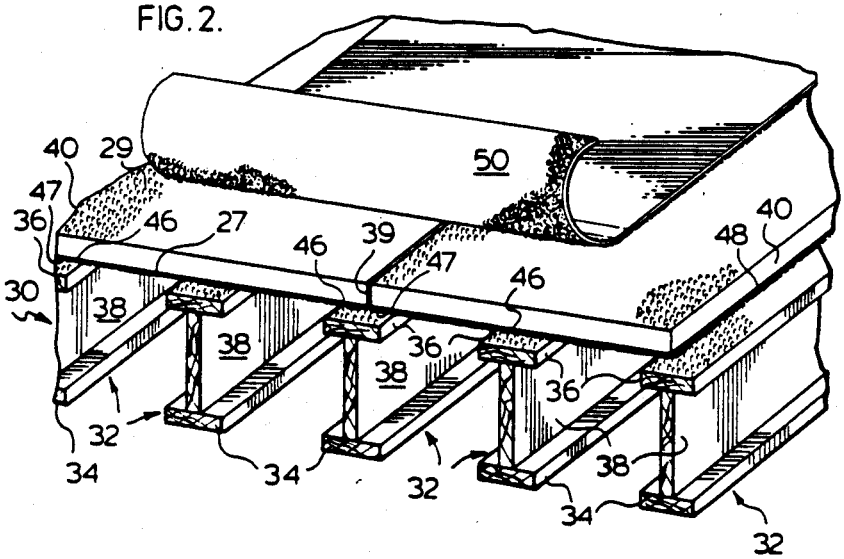
FIG. 2 is a general view of a structural floor system in accordance with the present invention.

Referring to FIG. 2, a portion 30 of a floor construction is shown. Illustrated are fabricated joists 32, each comprising a pair of opposed flanges 34, 36 having a web 38 secured therebetween. Such joists 32 can be of extruded light alloy such as aluminum, or fabricated of metal, or of wood and plywood as indicated.

The ends of joists 32 usually are supported by peripheral basement walls (not shown).

A subfloor comprising panels 40 is supported by joists 32. At the interface contact areas 46 and 47 are located area fastening elements secured to the respective components comprising loops 27 and hooks 29, to hold the respective components in mutually anchored relation. A flexible, protective cover sheet 50 overlies the upper surface of floor panels 40, being arranged to cover the floor panel intermediate gaps or joints 39.

During the erection of a building, sheet 50 may comprise a protective over-flooring element, to safeguard the underlying, upwardly extending hook portions 29 against damage from above. Once the building is erected and the finishing work completed, the protective sheet 50 can be removed and 4×8 sheets of plywood for a flooring system having a complementary loop layer on the underface thereof or a covering carpet with a looped underface, as disclosed in my copending application Ser. No. 136,953 can be installed.

Figure 3:
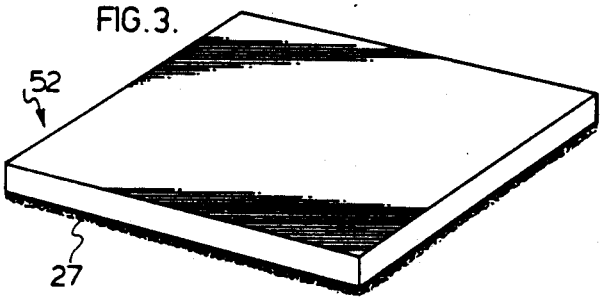
FIGS. 3 and 4 are general views of structural elements incorporating component connecting means in accordance with the invention.

FIG. 3 shows a substantially rigid panel 50 having a layer of loop elements 27 on one face thereof. This panel may comprise a finished surface element, which can be attached to installed hook elements 29 of a construction.

Figure 5:
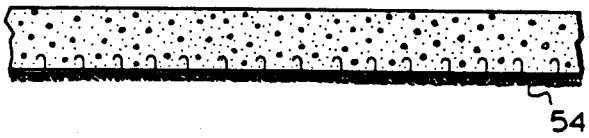
FIG. 5 is a sideview section of a poured ceiling or roof incorporating one element of a connecting means combination in installed relation therewith.
Figure 6:
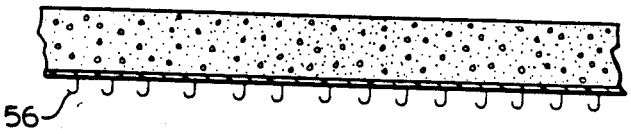
FIG. 6 is a view similar to FIG. 5, the ceiling incorporating the complementary elements of the connecting means combination.
Figure 6:
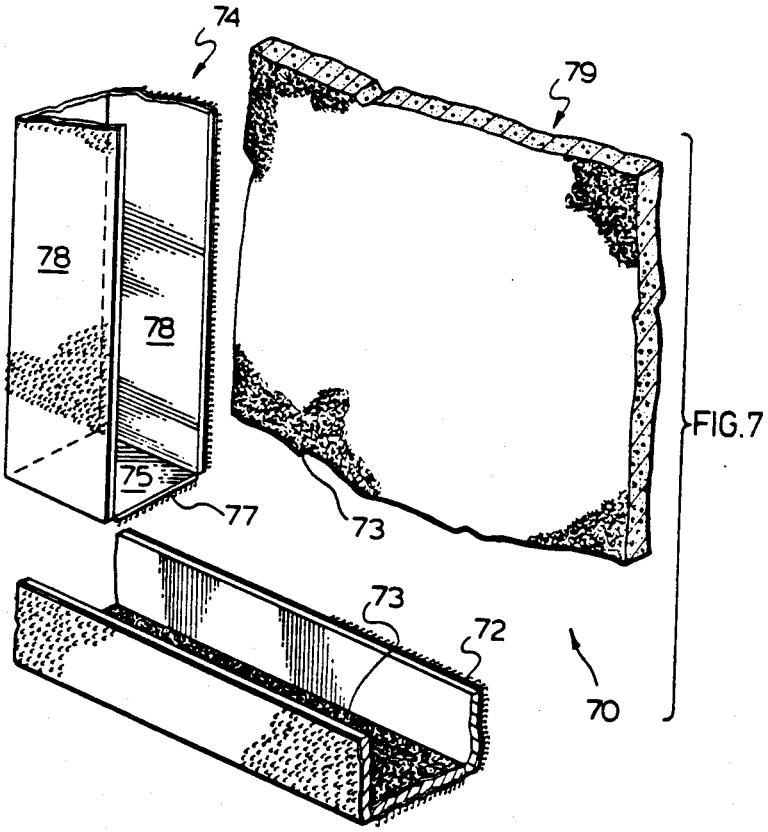

In the case of a poured ceiling surface, as illustrated in FIGS. 5 and 6, respective surface area attachment elements 54, 56 can be secured in situ at the time of pouring the concrete ceiling, or subsequently applied thereto. The enhanced utility achieved in making the surface area elements 54 or 56 as part of the formwork illustrated in FIG. 1, by appropriate adaptations, can be readily appreciated. Thus, in the case of the ceiling embodiment referred to in the FIG. 1 arrangement, a covering 41 may be either releasable so that it does not attach to the concrete or it may include upwardly extending loops or hooks, so as to bond the covering 41 to the undersurface of a ceiling that is poured thereover. It will be understood that the undersurface of covering 41 also is provided with hooks or loops, the selection of loops or hooks being appropriate to the fastening elements incorporated with the finish ceiling surface to be suspended therefrom. Further, fastening elements complementary to the selected elements of the undersurface of covering 41 will be secured to the upper surface of sheathing sheets 18, to enable detachable attachment of covering 41 to sheets 18, to facilitate initial assembly, and subsequent disassembly of the formwork.

Figure 4:
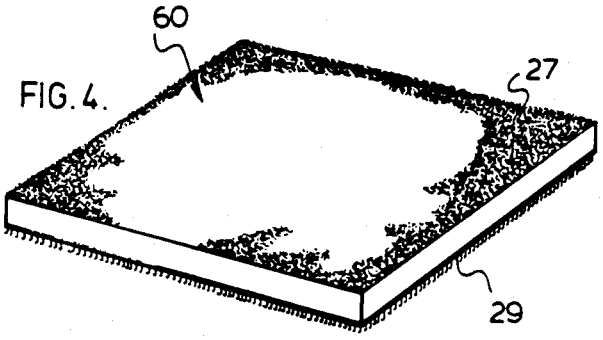

FIG. 4 illustrates a panel 60 having a layer of loop elements 27 and hook elements 29 thereon, for use as an intermediate construction.

In operation, referring first to FIG. 1, a supporting grill work of elements 12, 14, 16 is erected. The presence at the respective interface areas of the hook/loop area attachments permits assembly without nailing or other auxiliary fastening steps. Similarly, the sheathing sheets 18 ar readily positioned in place and secured by the weight of the sheeting, together with the temporary application of downward force thereon, to engage the respective loop and hook elements 27, 29.

The barrier sheet 41 protects the upper surface of the sheathing sheets 18 so that liquid concrete cannot penetrate between adjacent sheets 18. This minimizes the need for subsequent joist-flash grinding. In the case of the sheathing sheet members 18, it is contemplated that they may be fabricated of materials other than plywood, such as aluminum composites having a foam core, in order to reduce the weight of these members while maintaining adequate structural strength and rigidity.

The barrier sheet 41 may have a treated upper surface thereon, to facilitate bonding with the concrete when it is poured, or a surface barrier layer which precludes such bonding. Also, the upper surface of sheet 41 may have recesses or protrusions, to facilitate in-situ bonding to the poured concrete.

In FIG. 2, suitable floor joists such as the illustrated prefabricated joists are installed at the requisite intervals. The joists 32 may also incorporate area attachment elements in accordance with the present invention at their end lower surfaces to facilitate their installation. The sub-floor panels 40 are then positioned in place where temporary downward force will engage the interface fastener elements, loops 27 and hooks 29.

A protective flexible sheeting 50 then is laid over the sub-floor, so as to cover the intermediate joists 39. The purpose of the sheeting 50 is to protect hook elements 29 of the subfloor panels 40. Once construction activity, such as that of the allied trades, electricians, plumbers, carpenters is completed, a carpet having a looped undersurface in accordance with my copending application Ser. No. 136,953 can be substituted for the sheeting 50.

In dissassembling the subject system it will be understood that, owing to the potentially large securing forces that can be generated between the interface attachment hook and loop means, the use of auxiliary mechanisms, such as pry bars or pulling mechanisms may be required.

Referring to FIG. 7 a portion of a partition wall assembly 70 is shown. A sill piece 72 of U-section, having fastening elements 73 therein receives a stud member 74 in inserted relation. An end under-face of portion 75 of stud member 74 has fastening elements 77 thereon, to engage the fastening elements 73 of sill piece 72. The side portions 78 of stud member 74 have the outer faces thereof covered or at least partially covered with fastening elements 77, to which the elements 73 of sheet 79 can adhere. In use a partition wall can be readily and rapidly assembled to provide a partition wall of adequate strength, yet which can be readily disassembled. The sill piece 72 may also be provided with attachment elements 73 or 77 on the underface thereof. The partition wall elements 72 and 74 are generally of rolled metal, of thin section, similar to the metal studs and sills presently used with nailing constructions.

It will be understood that the foregoing disclosed embodiments are illustrative of the invention and modifications thereto can be made, within the scope of the claims appended hereto.

What I claim is:

1. A building construction comprising a plurality of rigid components for assembly in layered, substantially planar facing relation wherein:

a first component comprises a sheet member manufactured having a first part of a hook and loop fastening system substantially uniformly adhering to, covering and supported across at least a first surface of the sheet member; and a second such component comprises a support member manufactured having a second part of a hook and loop fastening system of complementary attachability to the first part and substantially uniformly adhering to, covering and supported across at least a second surface of the support member, wherein the first and second components may be sized on site and detachably engage each other in the building construction.

2. The building construction as set forth in claim 1, having a plurality of construction layers, having the parts of the hook and loop system between more than one pair of interfaces of the construction layers.

3. The building construction as set forth in claim 1 further comprising a removable covering layer secured in detachable, substantially concealing relation to the sheet member along a third surface.

4. The building construction as set forth in claim 2, wherein the first component comprises a ceiling.

5. The building construction as set forth in claim 2, wherein the first component comprises a floor.

6. The building construction of claim 1 wherein the first surface is substantially planar, the second surface is substantially planar and the first and second surfaces are substantially horizontal.

7. The building construction as set forth in claim 5, wherein the sheet member is a wall sheathing member.

8. The building construction of claim 6 wherein the sheet member is a floor panel having a first part of a hook and loop fastening system substantially uniformly adhering to, covering and supported across an upper surface, for attachment of a carpet thereto.

9. The building construction of claim 6 wherein the sheet member is a sheathing member and the support member is a joist member, the joist member having a second part of a hook and loop fastening system substantially uniformly adhering to, covering and supported across a third surface opposing the second surface, the second component further comprises a plurality of joist members, and a third component comprises a plurality of beam members having a first part of a hook and loop fastening system of complimentary attachability to the second part of the third surface substantially uniformly adhering to, covering and supported across at least a fourth surface.

10. The building construction of claim 9, wherein the first component further comprises a plurality of sheathing members having mutually substantially abutting edges and each sheathing member having a first part of a hook and loop fastening system, substantially uniformly supported across an upper surface; and wherein the construction further comprises an overlay cover having a lower surface substantially covered with a second part of a hook and loop fastening system of complementary attachability to the first part of the upper surface, secured to the upper surface of the sheathing members and located to cover the abutting edges to preclude liquid concrete from entering the area of the abutting edge.

11. The building construction of claim 10 wherein an upper surface of the overlay cover comprises attachment means to enable bonding of the overlay cover with the concrete when cast thereon.

12. The building construction of claim 10 wherein an upper surface of the overlay cover comprises release means to preclude bonding of the overlay cover with the concrete when cast thereon and to facilitate removal of the overlay cover from the concrete when the concrete is set.

13. The building construction of claim 1 wherein the first surface is substantially planar, the second surface is substantially planar and the first and second surfaces are similarly inclined.

14. The building construction of claim 13 wherein the sheet member is a sheathing member and the second component is a stud member and the first and second components are elements of a prefabricated wall structure.

15. The building construction of claim 14 wherein the prefabricated wall structure is a partition wall.

16. The building construction of claim 1 wherein each component is of generally uniform cross-section at areas where it may be required to be cut.

* * * * *

UNITED STATES PATENT AND TRADEMARK OFFICE

CERTIFICATE OF CORRECTION

PATENT NO. : 4,974,384

DATED : December 4, 1990

INVENTOR(S) : Joseph R. Pacione

It is certified that error appears in the above-identified patent and that said Letters Patent is hereby corrected as shown below:

On the title page item [73]:
In the Assignee, change "System" to -- Systems --.

In claim 4, change "2" to -- 3 --.

In claim 5, change "2" to -- 3 --.

In claim 7, change "5" to -- 6 --.

Signed and Sealed this

Seventh Day of April, 1992

*Attest:*

HARRY F. MANBECK, JR.

*Attesting Officer*

*Commissioner of Patents and Trademarks*